US011206469B2

(12) United States Patent
Yang et al.

(10) Patent No.: US 11,206,469 B2
(45) Date of Patent: Dec. 21, 2021

(54) HEADSET ACCOMMODATING APPARATUS, HEADSET, AND PORTABLE DEVICE

(71) Applicant: HUAWEI TECHNOLOGIES CO., LTD., Guangdong (CN)

(72) Inventors: Rongguang Yang, Dongguan (CN); Menglong Zhao, Dongguan (CN); Bin Zhang, Dongguan (CN); Yanguo He, Xi'an (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/753,131

(22) PCT Filed: Apr. 3, 2018

(86) PCT No.: PCT/CN2018/081656

§ 371 (c)(1),
(2) Date: Apr. 2, 2020

(87) PCT Pub. No.: WO2019/080453

PCT Pub. Date: May 2, 2019

(65) Prior Publication Data

US 2020/0296491 A1 Sep. 17, 2020

(30) Foreign Application Priority Data

Oct. 27, 2017 (CN) ..... 201711027175.1

(51) Int. Cl.
*H04R 1/02* (2006.01)
*H04R 1/10* (2006.01)

(52) U.S. Cl.
CPC ..... *H04R 1/02* (2013.01); *H04R 1/10* (2013.01)

(58) Field of Classification Search
None
See application file for complete search history.

(56) References Cited

U.S. PATENT DOCUMENTS 7,959,351 B1 6/2011 Thorpe
2004/0057578 A1* 3/2004 Brewer ..... G04G 21/04 379/433.1

(Continued)

FOREIGN PATENT DOCUMENTS

CN 202524445 U 11/2012
CN 202750212 U 2/2013

(Continued)

*Primary Examiner* — James K Mooney

(57) ABSTRACT

This application provides a headset accommodating apparatus, a headset, and a portable device. The headset accommodating apparatus includes a base, and an accommodating cavity used to accommodate a headset is formed on the base. The accommodating cavity has a bottom surface, a side wall, and an opening, and has a first end corresponding to a headset head and a second end corresponding to a headset tail. An epitaxial frame that extends toward the second end is formed at an opening of the first end. The apparatus includes a first spring and a sliding block at a side wall of the second end, and the first spring may be compressed in a direction of a connecting line between the first end and the second end. A first end of the sliding block is connected to the first spring, and a protruding part is formed on a second end of the sliding block.

12 Claims, 13 Drawing Sheets

(56) References Cited

U.S. PATENT DOCUMENTS

| | | | | |
|---|---|---|---|---|
| 2007/0042821 | A1* | 2/2007 | Lee | H04B 1/385<br>455/575.6 |
| 2015/0172429 | A1* | 6/2015 | Cai | H04M 1/0258<br>455/41.2 |
| 2015/0181324 | A1* | 6/2015 | Hsieh | A61B 5/024<br>381/74 |

FOREIGN PATENT DOCUMENTS

| | | | |
|---|---|---|---|
| CN | 204231644 | U | 3/2015 |
| CN | 106507249 | A | 3/2017 |

* cited by examiner

HEADSET ACCOMMODATING APPARATUS, HEADSET, AND PORTABLE DEVICE

This application is a national stage of International Application No. PCT/CN2018/081656, filed on Apr. 3, 2018, which claims priority to Chinese Patent Application No. 201711027175.1, filed on Oct. 27, 2017, the contents of each of which are hereby incorporated by reference in their entirety.

TECHNICAL FIELD

This application relates to the technical field of portable equipment, and in particular, to a headset accommodating apparatus, a headset, and a portable device.

BACKGROUND

With advancement of science and technology, people use a portable device increasingly frequently in daily life, for example a smart watch, a smart band, a Bluetooth headset, and smart glasses. Various portable devices may have some identical functions, or may have completely different functions. To implement as many functions of the portable devices as possible while reducing space occupied by these portable devices, a future development trend of portable devices is to be multifunctional and easy to carry.

At present, a product that combines a Bluetooth headset and a smart band (or a smart watch, or the like) appears. A user can access original functions of both the Bluetooth headset and the smart band by using the product. In addition, the Bluetooth headset is accommodated in the smart band. However, in such a current product, an accommodating structure of the Bluetooth headset is usually relatively complex, occupying relatively large space. In addition, it takes a relatively long time to take out and place back the Bluetooth headset, and the Bluetooth headset even falls off easily when it is taken out, leading to poor user experience.

SUMMARY

This application provides a headset accommodating apparatus, a headset, and a portable device, to resolve a problem in the conventional art that a headset is difficult to be placed into and taken out from its accommodating apparatus.

According to a first aspect, this application provides a headset accommodating apparatus. The apparatus includes: a base.

An accommodating cavity used to accommodate a headset is formed on the base. The accommodating cavity has a bottom surface, a side wall, and an opening, and has a first end corresponding to a headset head and a second end corresponding to a headset tail. An epitaxial frame that extends toward the second end is formed at an opening of the first end; and the apparatus includes a first spring and a sliding block at a side wall of the second end. The first spring may be compressed in a direction of a connecting line between the first end and the second end, a first end of the sliding block is connected to the first spring, and a protruding part is formed on a second end of the sliding block.

When the apparatus is in a first state, a protruding end of the headset head is limited within the accommodating cavity by the epitaxial frame, and the protruding part on the sliding block is clamped to a recess part of the headset tail.

When the apparatus is in a second state, the sliding block compresses the first spring under a push of the headset, and the protruding end of the headset head moves toward the second end to detach from the epitaxial frame, so that the headset can be released from the opening.

In a possible implementation, the apparatus further includes: an insurance mechanism.

The insurance mechanism includes a clamp spring, a second spring, and an insurance button. The insurance button is removably fastened on the side wall of the accommodating cavity by using the clamp spring and the second spring. The insurance button includes a first end facing an inner side of the accommodating cavity, a second end facing an outer side of the accommodating cavity, and a coupling shaft connecting the first end and the second end. A fitting hole is provided on the side wall of the accommodating cavity, and the first end of the insurance button is inserted into the accommodating cavity through the fitting hole. An axial end surface parallel to an axial direction of the coupling shaft is formed at the first end of the insurance button.

On the headset tail, a concave cavity is further formed on a side close to the insurance mechanism. A first concave plane and a second concave plane are formed in a step-shape in the concave cavity. Compared with the second concave plane, the first concave plane is closer to an outer side of the headset, and a distance from the second concave plane to the headset head is shorter than a distance from the first concave plane to the headset head.

When the apparatus is in the first state, the axial end surface is in contact with a first concave plane on the headset tail.

When the apparatus is in the second state, the insurance button compresses the second spring, the axial end surface is detached from the first concave plane, and moves in an axial direction to a position that is opposite to the second concave plane in the concave cavity.

In a possible implementation, the fitting hole includes a through-hole and a recessed surface, and a cross section of the through-hole is smaller than the recessed surface. A groove is provided on the coupling shaft at a position close to the first end of the insurance button, and the clamp spring is inserted into the groove and fastened on the side wall. One end of the second spring is in contact with the second end of the insurance button, and the other end of the second spring is in contact with the recessed surface. A thickness of the clamp spring is less than a width of the groove. The second spring may be compressed in an axial direction of the coupling shaft under the push of the insurance button.

In a possible implementation, the apparatus further includes: a fastening block.

One end of the fastening block is fastened on the second end of the accommodating cavity by using a screw, and the other end of the fastening block is connected to the first spring.

According to a second aspect, this application provides a headset. The headset can be detachably accommodated in the headset accommodating apparatus according to the first aspect. A protruding end is formed at a headset head, and a recess part is formed at a headset tail.

When the apparatus is in a first state, the protruding end of the headset head is limited within an accommodating cavity in the apparatus by an epitaxial frame of the apparatus; and the recess part of the headset tail is clamped to a protruding part of a sliding block in the apparatus.

When the apparatus is in a second state, the headset pushes the sliding block to compress the first spring, the protruding end of the headset head moves toward a second end of the accommodating cavity to detach from the epitaxial frame, so that the headset can be released from the opening.

In a possible implementation, on the headset tail, a concave cavity is further formed on a side close to the insurance mechanism, and a first concave plane and a second concave plane are formed in a step-shape in the concave cavity. Compared with the second concave plane, the first concave plane is closer to an outer side of the headset, and a distance from the second concave plane to the headset head is shorter than a distance from the first concave plane to the headset head.

The apparatus further includes an insurance mechanism. The insurance mechanism includes a clamp spring, a second spring, and an insurance button. The insurance button is removably fastened on a side wall of the accommodating cavity by using the clamp spring and the second spring. The insurance button includes a first end facing an inner side of the accommodating cavity, a second end facing an outer side of the accommodating cavity, and a coupling shaft connecting the first end and the second end. A fitting hole is provided on the side wall of the accommodating cavity, and the first end of the insurance button is inserted into the accommodating cavity through the fitting hole. An axial end surface parallel to an axial direction of the coupling shaft is formed at the first end of the insurance button.

When the apparatus is in the first state, a first concave plane on the headset tail is in contact with the axial end surface of the insurance mechanism.

In a possible implementation, when the apparatus is in the second state, a second concave plane on the headset tail moves at most to contact with the axial end surface of the insurance mechanism.

According to a third aspect, this application provides a portable device. The portable device includes a headset accommodating apparatus provided in any implementation of the first aspect.

In a possible implementation, the portable device may further include a headset provided in any implementation of the second aspect.

According to the headset accommodating apparatus, the headset, and the portable device provided in the embodiments of this application, the epitaxial frame is disposed on one end of the accommodating cavity formed on the base, and the first spring and the sliding block are disposed on the other end. The protruding end is provided at the headset head, and the recess part is provided at the headset tail. The headset is pressed downward, and the sliding block is pushed to compress the first spring, so that the protruding part on the sliding block is clamped to the recess part of the headset tail, and the protruding end of the headset head is limited within the accommodating cavity by the epitaxial frame, so that the headset can be conveniently, quickly, and stably accommodated in the headset accommodating apparatus. When the headset needs to be taken out, the headset is pressed toward the second end of the accommodating cavity, the sliding block is pushed to compress the first spring, and the protruding end of the headset head moves toward the second end of the accommodating cavity to detach from the epitaxial frame, so that the headset can be conveniently and quickly taken out from the headset accommodating apparatus.

Further, by disposing the insurance mechanism, when the insurance button is not pressed, the headset cannot be released from the accommodating apparatus, thereby preventing the headset from falling off due to an external force and is lost without being realized by a user. Still further, by using an implementation in which the second concave plane of the headset tail moves at most to contact with the axial end surface, a compression length obtained when the headset pushes the sliding block to compress the first spring may be limited, to effectively avoid a situation in which the headset flies out and be broken because of an excessively strong restoring force generated by the first spring when a user takes out the headset from the headset accommodating apparatus. In addition, by disposing the fastening block, when a joint between the second spring and the fastening block, or the like in the headset accommodating apparatus is damaged, the entire base does not need to be replaced, but only the fastening block needs to be replaced, thereby reducing economic loss of a user and improving customer experience.

DESCRIPTION OF EMBODIMENTS

The following describes the technical solutions in the embodiments of this application with reference to the accompanying drawings in the embodiments of this application.

Figure 1A:
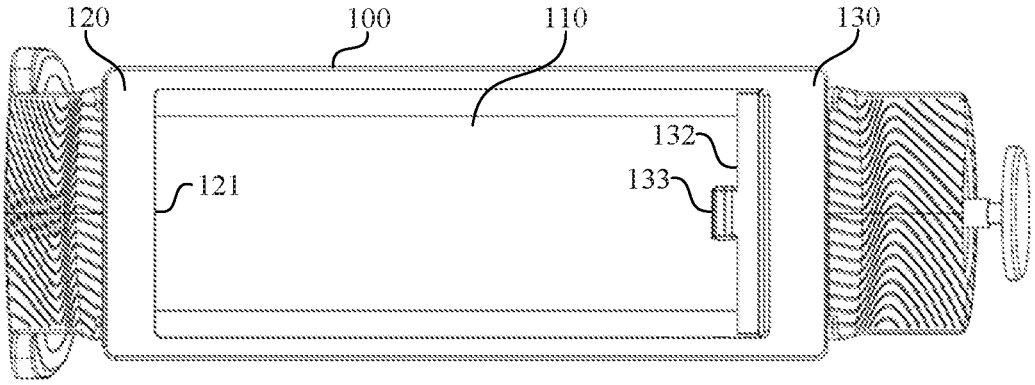
FIG. 1*a* is a structural top view of a headset accommodating apparatus according to an embodiment of this application.
Figure 1B:
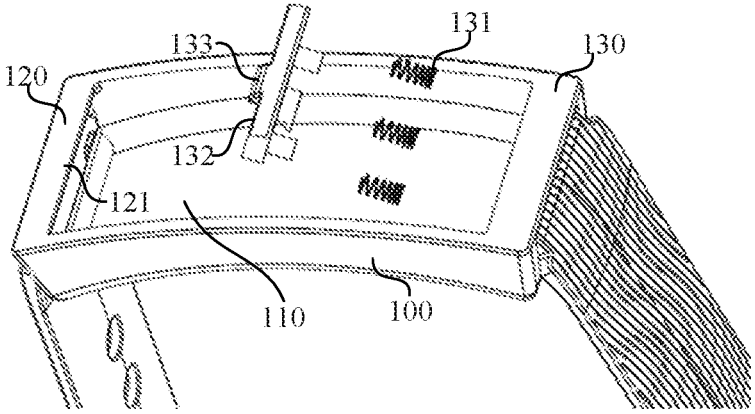
FIG. 1*b* is an oblique view of a headset accommodating apparatus according to an embodiment of this application.
Figure 1C:
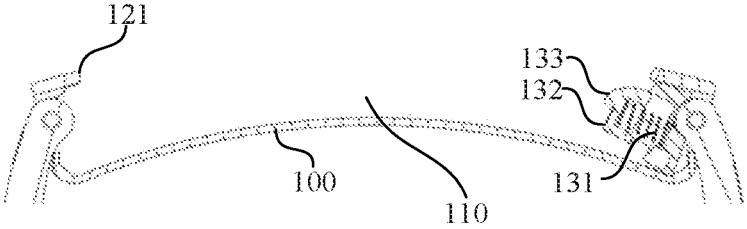
FIG. 1*c* is a sectional view of a headset accommodating apparatus according to an embodiment of this application.

FIG. 1*a* is a structural top view of a headset accommodating apparatus according to an embodiment of this application. FIG. 1*b* is an oblique view of a headset accommodating apparatus according to an embodiment of this application. FIG. 1*c* is a sectional view of a headset accommodating apparatus according to an embodiment of this application. As shown in FIG. 1*a*, FIG. 1*b*, and FIG. 1*c*, the apparatus includes a base 100. An accommodating cavity 110 used to accommodate a headset is formed on the base 100. The accommodating cavity 110 has a bottom surface, a side wall, and an opening, and has a first end 120 corresponding to a headset head and a second end 130 corresponding to a headset tail. An epitaxial frame 121 that extends toward the second end is formed at an opening of the first end. The apparatus includes a first spring 131 and a sliding block 132 at a side wall of the second end. The first spring 131 may be compressed in a direction of a connecting line between the first end 120 and the second end 130. A first end of the sliding block 132 is connected to the first spring 131, and a protruding part 133 is formed on a second end of the sliding block 132.

Figure 2A:
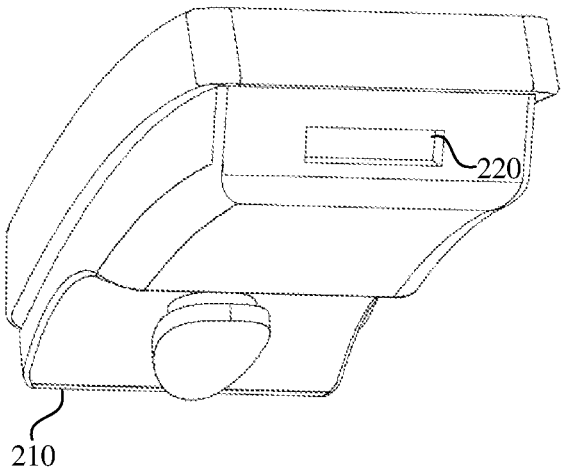
FIG. 2*a* is a schematic structural diagram of a headset according to an embodiment of this application.
Figure 2B:
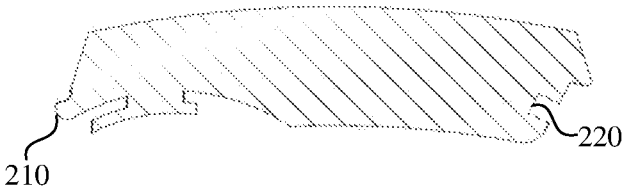
FIG. 2*b* is a sectional view of a headset according to an embodiment of this application.

FIG. 2*a* is a schematic structural diagram of a headset according to an embodiment of this application, and FIG. 2*b* is a sectional view of a headset according to an embodiment of this application. As shown in FIG. 2*a* and FIG. 2*b*, a protruding end 210 is formed at a headset head, and a recess part 220 is formed at a headset tail. The headset shown in FIG. 2*a* and FIG. 2*b* can be detachably accommodated in the headset accommodating apparatus shown in FIG. 1*a*, FIG. 1*b*, and FIG. 1*c*.

Figure 3A:
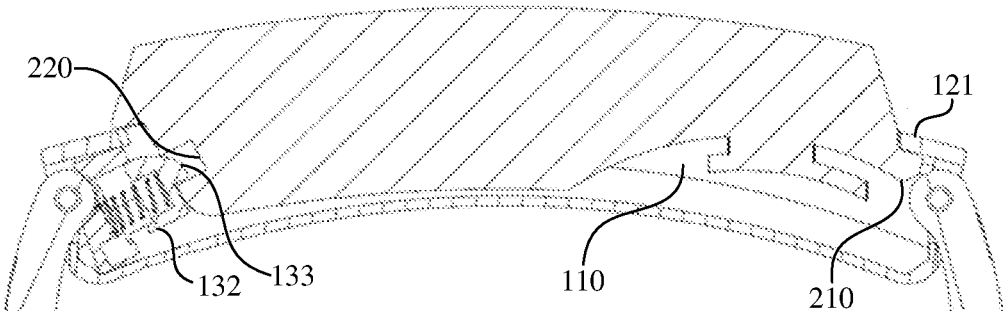
FIG. 3*a* is a diagram of a headset accommodating apparatus according to an embodiment of this application.

In an embodiment, as shown in FIG. 3*a*, when the headset accommodating apparatus is in a first state, for example, the first state is that the headset in the apparatus is stably accommodated in the headset accommodating apparatus, the protruding end 210 of the headset head is limited within the accommodating cavity 110 in the apparatus by the epitaxial frame 121 of the headset accommodating apparatus, and the recess part 220 of the headset tail is clamped to the protruding part 133 of the sliding block 132 in the apparatus.

Figure 3B:
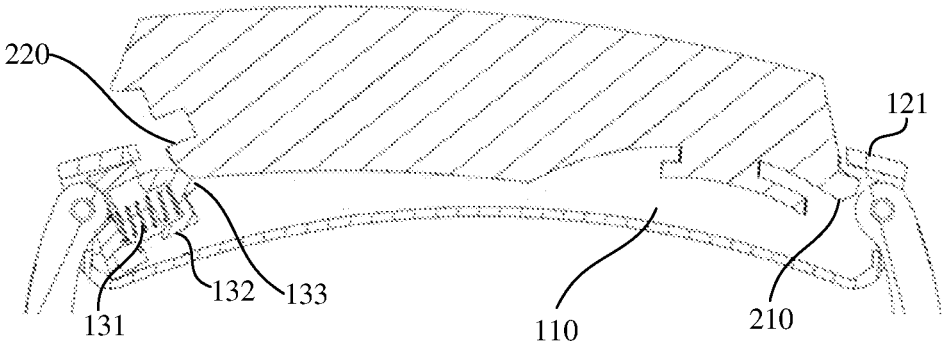
FIG. 3*b* is another diagram of headset accommodating apparatus according to an embodiment of this application.

In another embodiment, as shown in FIG. 3*b*, when the headset accommodating apparatus is in a second state, for example, the second state is that the headset is being placed into the apparatus, the protruding end 210 of the headset head is limited within the accommodating cavity 110 in the apparatus by the epitaxial frame 121 of the headset accommodating apparatus. The headset pushes the sliding block 132 to compress the first spring 131, so that the recess part 220 of the headset tail is clamped to the protruding part 133 of the sliding block 132 in the apparatus.

Figure 3C:
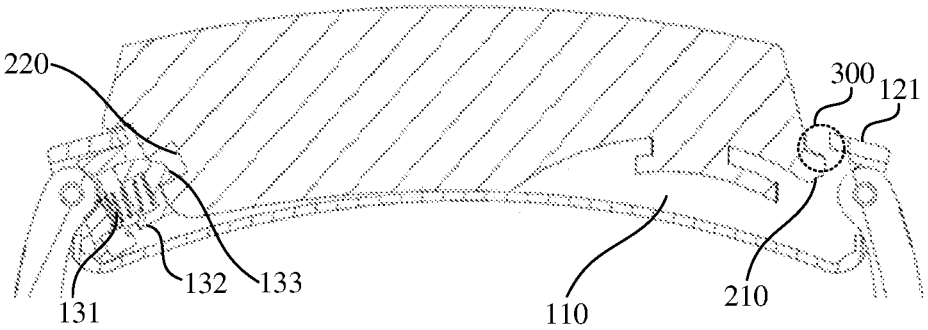
FIG. 3*c* is still another diagram of headset accommodating apparatus according to an embodiment of this application.

In another embodiment, as shown in FIG. 3*c*, when the headset accommodating apparatus is in the second state, for example, the second state is that the headset is being taken out from the apparatus, the headset pushes the sliding block 132 to compress the first spring 131, and the protruding end 210 of the headset head moves toward the second end 130 of the accommodating cavity 110 to detach from the epitaxial frame 121. In this case, an interstice (or opening) 300 is reserved between the headset head and the base cavity, and the headset can be rotated upward, so that the headset can be released from the opening of the accommodating cavity 110.

According to the headset accommodating apparatus and the headset provided in the embodiments of this application, the epitaxial frame 131 is disposed on one end of the accommodating cavity 110 formed on the base 100, and the first spring 131 and the sliding block 132 are disposed on the other end. The protruding end 210 is provided at the headset head, and the recess part 220 is provided at the headset tail. The headset is pressed downward, and the sliding block 132 is pushed to compress the first spring 131, so that the protruding part 133 on the sliding block 132 is clamped to the recess part 220 of the headset tail, and the protruding end 210 of the headset head is limited within the accommodating cavity 110 by the epitaxial frame 131, so that the headset can be conveniently, quickly, and stably accommodated in the headset accommodating apparatus. When the headset needs to be taken out, the headset is pressed toward the second end 130 of the accommodating cavity 110, the sliding block 132 is pushed to compress the first spring 131, and the protruding end 210 of the headset head moves toward the second end 130 of the accommodating cavity 110 to detach from the epitaxial frame 131, so that the headset can be conveniently and quickly taken out from the headset accommodating apparatus.

Figure 4A:
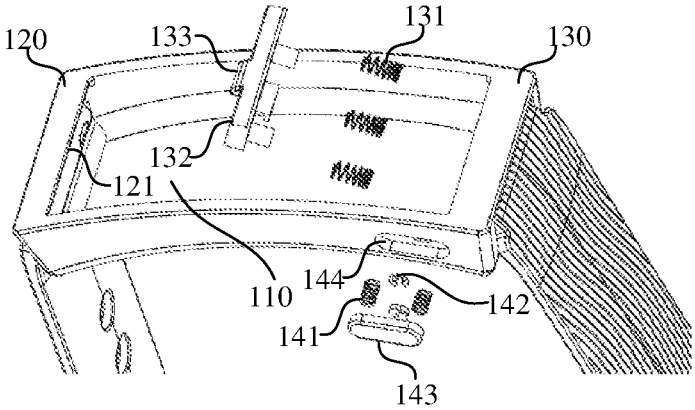
FIG. 4*a* is an oblique view of another headset accommodating apparatus according to an embodiment of this application.
Figure 4B:
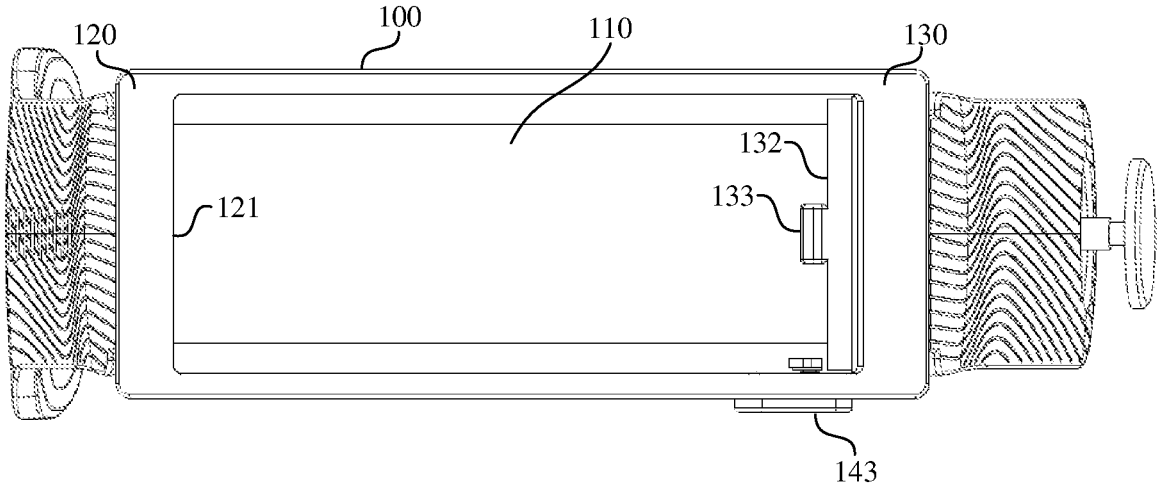
FIG. 4*b* is a structural top view of another headset accommodating apparatus according to an embodiment of this application.

FIG. 4*a* is an oblique view of another headset accommodating apparatus according to an embodiment of this application; and FIG. 4*b* is a structural top view of another headset accommodating apparatus according to an embodiment of this application. Compared with the apparatus shown in FIG. 1*a*, FIG. 1*b*, and FIG. 1*c*, the apparatus in FIG. 4*a* and FIG. 4*b* further includes an insurance mechanism. The insurance mechanism includes a clamp spring 141, a second spring 142, and an insurance button 143. The insurance button 143 is removably fastened on the side wall of the accommodating cavity 110 by using the clamp spring 141 and the second spring 142. A fitting hole 144 is provided on the side wall of the accommodating cavity, and one end of the insurance button 143 is inserted into the accommodating cavity 110 through the fitting hole 144.

Figure 4C:
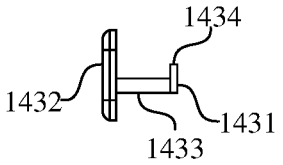
FIG. 4*c* is a schematic structural diagram of an insurance button according to an embodiment of this application.

In an embodiment, as shown in FIG. 4*c*, the insurance button 143 includes a first end 1431 facing an inner side of the accommodating cavity 110, a second end 1432 facing an outer side of the accommodating cavity 110, and a coupling shaft 1433 connecting the first end 1431 and the second end 1432; and an axial end surface 1434 parallel to an axial direction of the coupling shaft 1433 is formed at the first end 1431 of the insurance button 143.

Figure 4D:
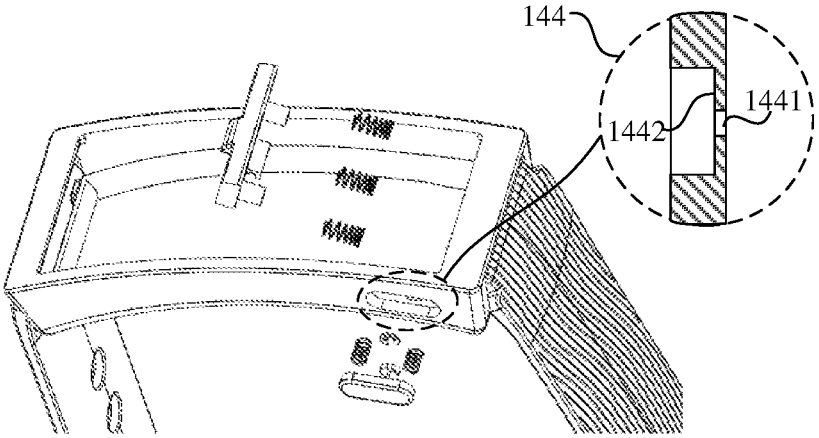
FIG. 4*d* is a schematic mechanism diagram of a fitting hole according to an embodiment of this application.
Figure 4E:
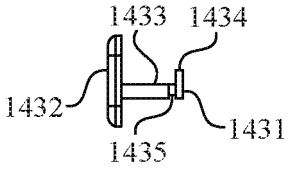
FIG. 4*e* is a schematic structural diagram of another insurance button according to an embodiment of this application.
Figure 4F:
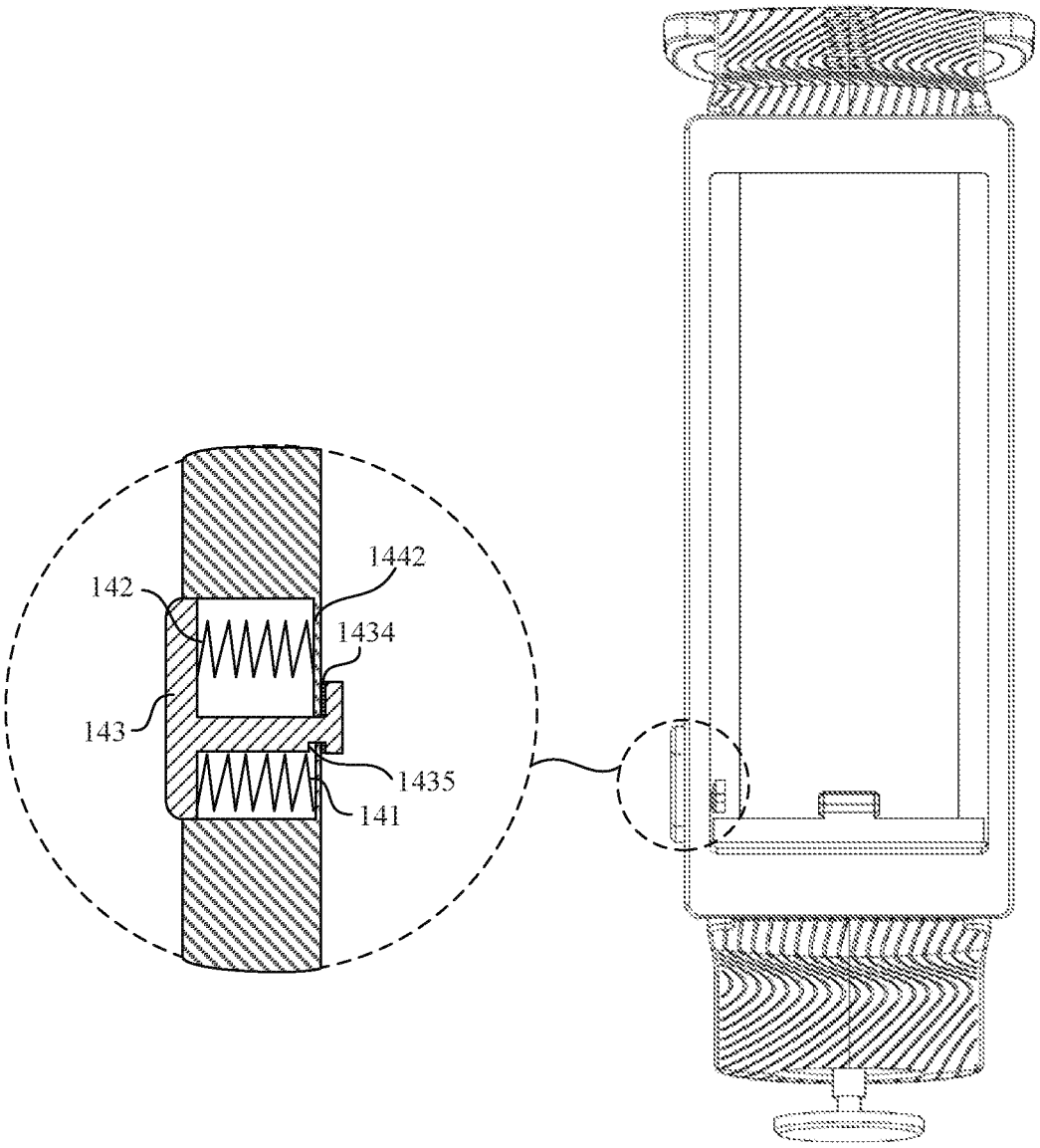
FIG. 4*f* is a schematic assembly diagram of an insurance mechanism according to an embodiment of this application.

Further, as shown in FIG. 4*d*, the fitting hole 144 includes a through-hole 1441 and a recessed surface 1442. A cross section of the through-hole 1441 is smaller than the recessed surface 1442. As shown in FIG. 4*e*, a groove 1435 is provided on the coupling shaft 1433 at a position close to the first end 1431 of the insurance button 143. As shown in FIG. 4*f*, the clamp spring 141 is inserted into the groove 1435 and fastened on the side wall of the accommodating cavity. One end of the second spring 142 is in contact with the second end 1432 of the insurance button 143, and the other end of the second spring 142 is in contact with the recessed surface 1442. A thickness of the clamp spring 141 is less than a width of the groove 1435, and the second spring 142 may be compressed in an axial direction of the coupling shaft 1433 under the push of the insurance button 143.

Figure 5:
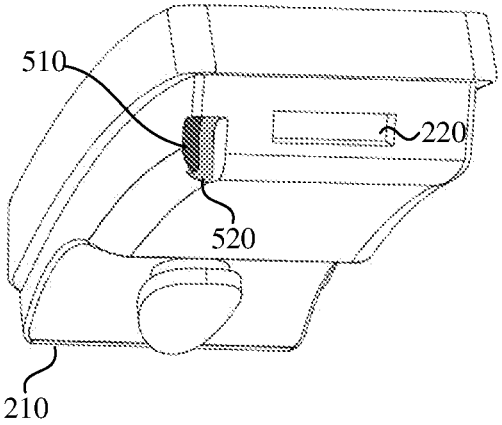
FIG. 5 is a schematic structural diagram of another headset according to an embodiment of this application.

FIG. 5 is a schematic structural diagram of another headset according to an embodiment of this application. Compared with the headset in FIG. 2*a* and FIG. 2*b*, a concave cavity is further formed on a side close to an insurance mechanism on a headset tail in FIG. 5. A first concave plane 510 and a second concave plane 520 are formed in a step-shape in the concave cavity. Compared with the second concave plane 520, the first concave plane 510 is closer to an outer side of the headset, and a distance from the second concave plane 520 to a headset head is shorter than a distance from the first concave plane 510 to the headset head. The headset shown in FIG. 5 can be detachably accommodated in the headset accommodating apparatus shown in FIG. 4*a* and FIG. 4*b*.

Figure 6A:
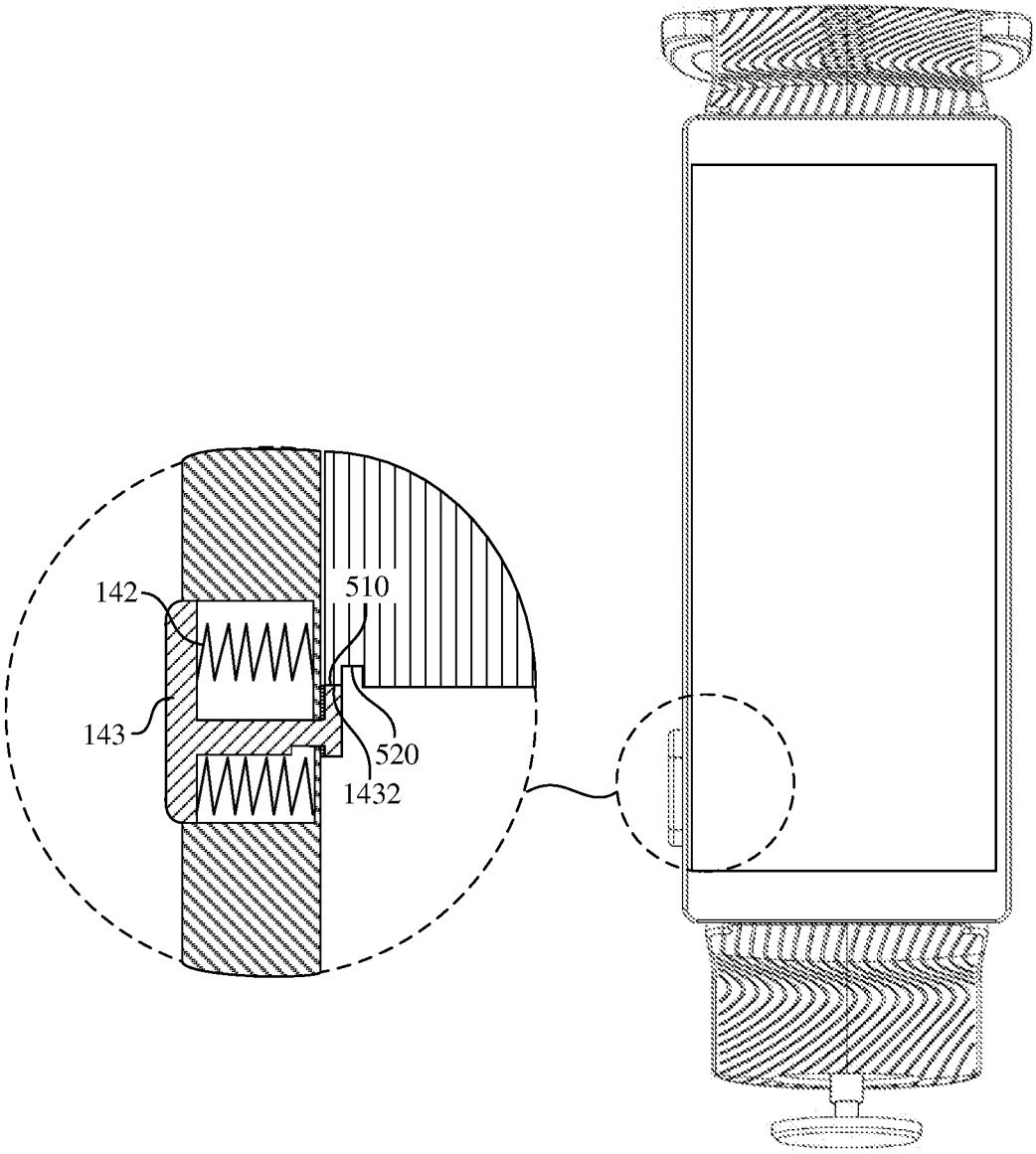
FIG. 6*a* is a diagram of an insurance mechanism according to an embodiment of this application.

In an embodiment, when the headset accommodating apparatus is in a first state, for example, the first state is that the headset in the apparatus is stably accommodated in the headset accommodating apparatus, as shown in FIG. 3*a*, the protruding end 210 of the headset head is limited within the accommodating cavity 110 in the apparatus by the epitaxial frame 121. The recess part 220 of the headset tail is clamped to a protruding part 133 of a sliding block 132 in the apparatus. In addition, as shown in FIG. 6*a*, the first concave plane 510 of the headset tail is in contact with an axial end surface 1434 of the first end 1431 of the insurance button 143. In this case, if the insurance button 143 is not pressed, the headset cannot move toward the second end 130 of the accommodating cavity 110, to prevent the headset from falling out from the headset accommodating apparatus.

In another embodiment, when the headset accommodating apparatus is in a first state, for example, the first state is that the headset is being placed into the apparatus. As shown in FIG. 3*b*, the protruding end 210 of the headset head is limited within the accommodating cavity 110 in the apparatus by the epitaxial frame 121 of the headset accommodating apparatus, and the headset pushes the sliding block 132 to compress the first spring 131, so that the recess part 220 of the headset tail is clamped to the protruding part 133 of the sliding block 132 in the apparatus. In this case, when the headset is placed into the headset accommodating apparatus, only the headset needs to be pressed, and the insurance button does not need to be pressed.

Figure 6B:
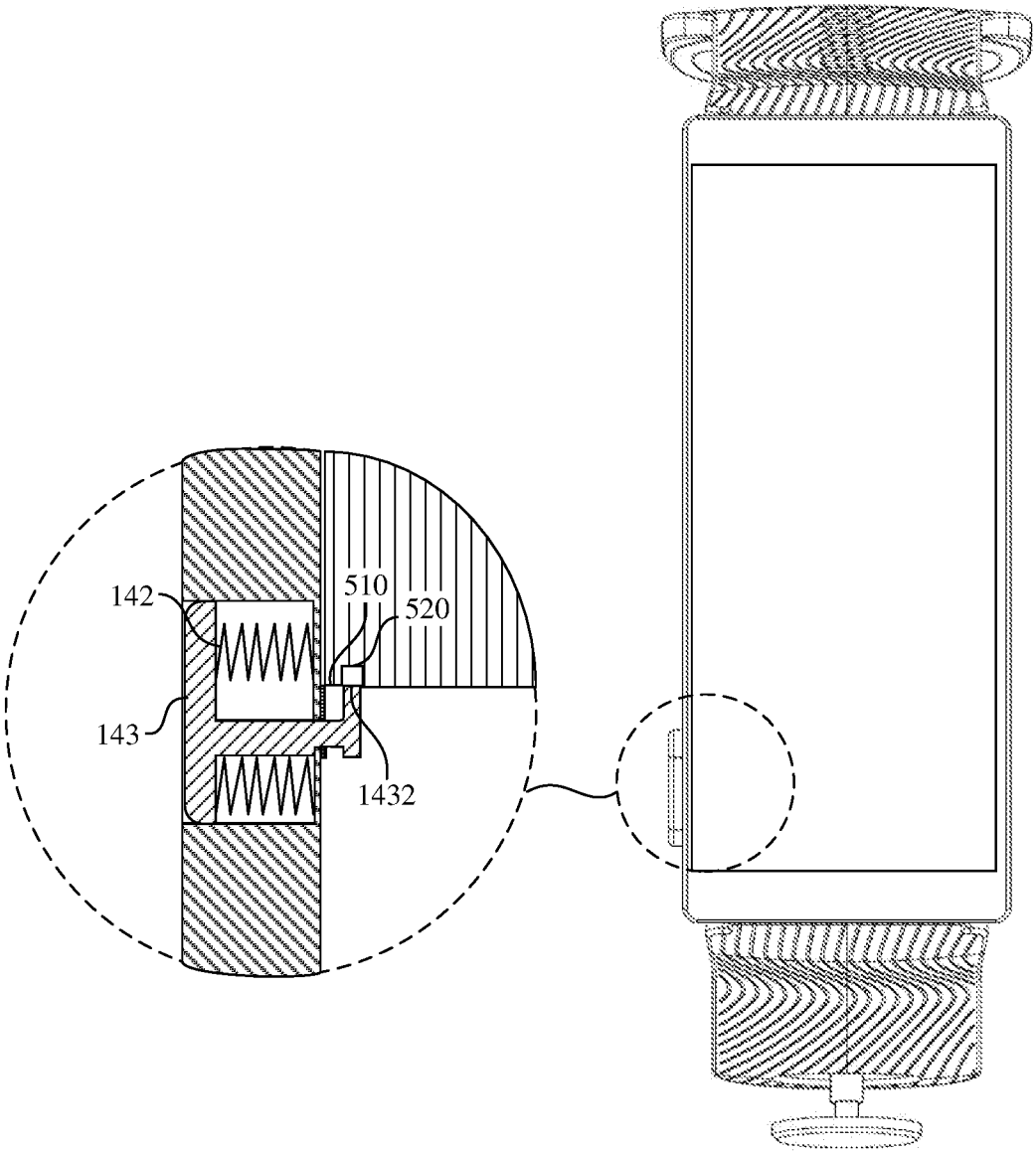
FIG. 6*b* is another diagram of an insurance mechanism according to an embodiment of this application.

In another embodiment, as shown in FIG. 6*b*, when the headset accommodating apparatus is in a second state, for example, the second state is that the headset is being taken out from the apparatus, the insurance button 143 compresses the second spring 142. The axial end surface 1434 on the first end 1431 of the insurance button 143 is detached from the first concave plane 510, and moves in an axial direction to a position that is opposite to the second concave plane 520 in the concave cavity. In this case, the headset can push the sliding block 132 to compress the first spring 131, and the protruding end 210 of the headset head moves toward the second end 130 of the accommodating cavity 110 to detach from the epitaxial frame 121. An interstice 300 is reserved between the headset head and the base cavity, and the headset can be rotated upward, so that the headset can be released from the opening of the accommodating cavity 110.

Still further, when the headset accommodating apparatus is in the second state, and the protruding end 210 of the headset head moves in a direction of the second end 130 of the accommodating cavity 110, correspondingly, the second concave plane 520 of the headset tail moves to make contact with the axial end surface 1434. By using this implementation, a compression length obtained when the headset pushes the sliding block 132 to compress the first spring 131 may be limited, to effectively avoid a situation in which the headset flies out and be broken because of an excessively strong restoring force generated by the first spring 131 when a user takes out the headset from the headset accommodating apparatus.

The following describes a process of a user taking out the headset from, and putting back the headset into, the headset accommodating apparatus.

Figure 7A:
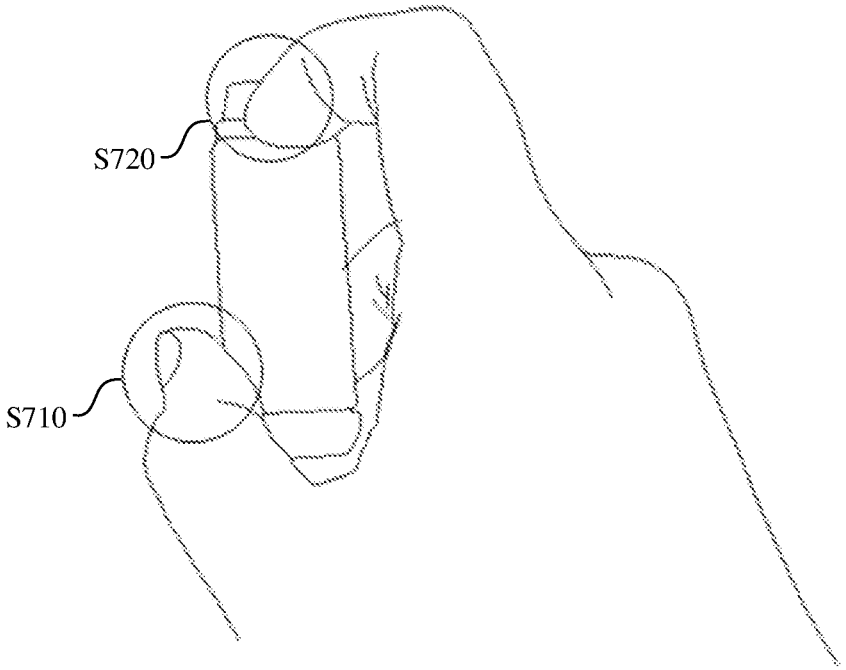
FIG. 7*a* is a schematic diagram of operating a headset according to an embodiment of this application.
Figure 7B:
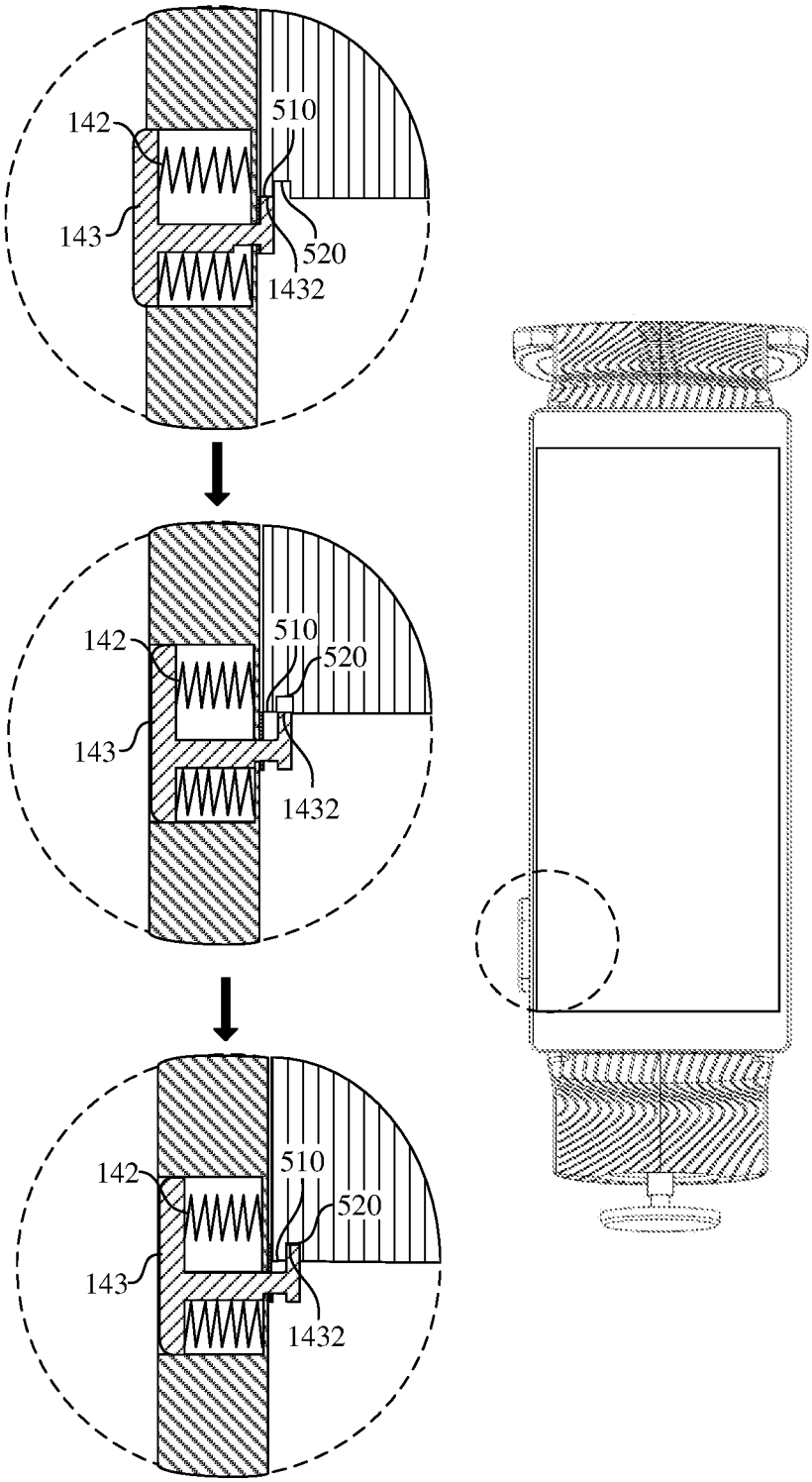
FIG. 7*b* is a diagram of a headset accommodating apparatus according to an embodiment of this application.
Figure 7C:
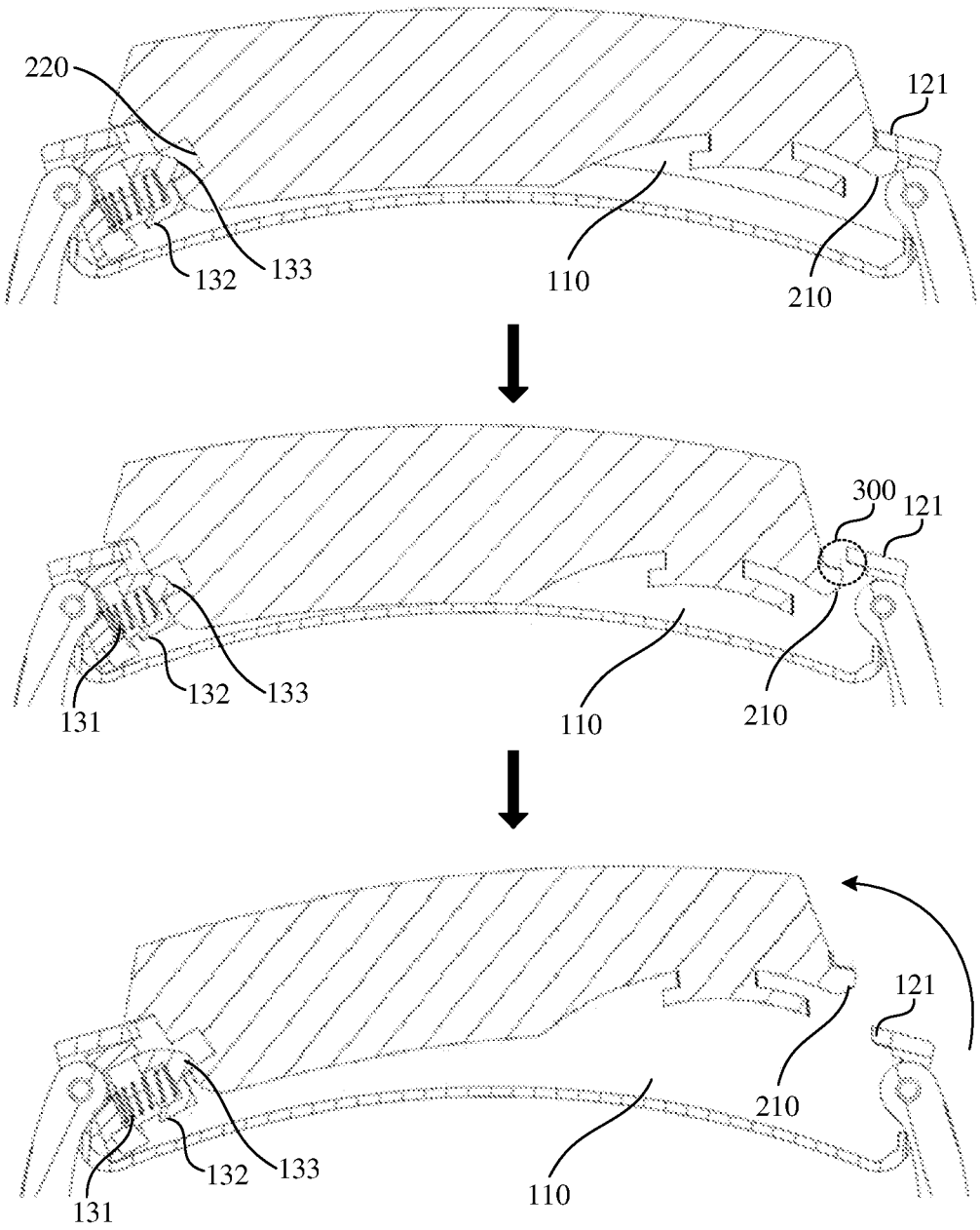
FIG. 7*c* is another diagram of a headset accommodating apparatus according to an embodiment of this application.

As shown in FIG. 7*a*, in step S710, a user presses the insurance button 143 with a thumb. In this case, as shown in FIG. 7*b*, the insurance button 143 compresses the second spring 142, the axial end surface 1434 on the first end 1431 of the insurance button 143 is detached from the first concave plane 510, and moves in an axial direction to a position that is opposite to the second concave plane 520 in the concave cavity. As shown in FIG. 7*a*, in step S720, a user pushes the headset toward the second end 130 of the accommodating cavity 110. In this case, as shown in FIG. 7*c*, the protruding end 210 of the headset head moves toward the second end 130 of the accommodating cavity 110 to detach from the epitaxial frame 121, and the interstice 300 is reserved between the headset head and the base cavity. As shown in FIG. 7*b*, the second concave plane 520 of the headset tail moves to contact with the axial end surface 1434. Then, as shown in FIG. 7*c*, the headset is rotated upward and taken out.

Figure 8:
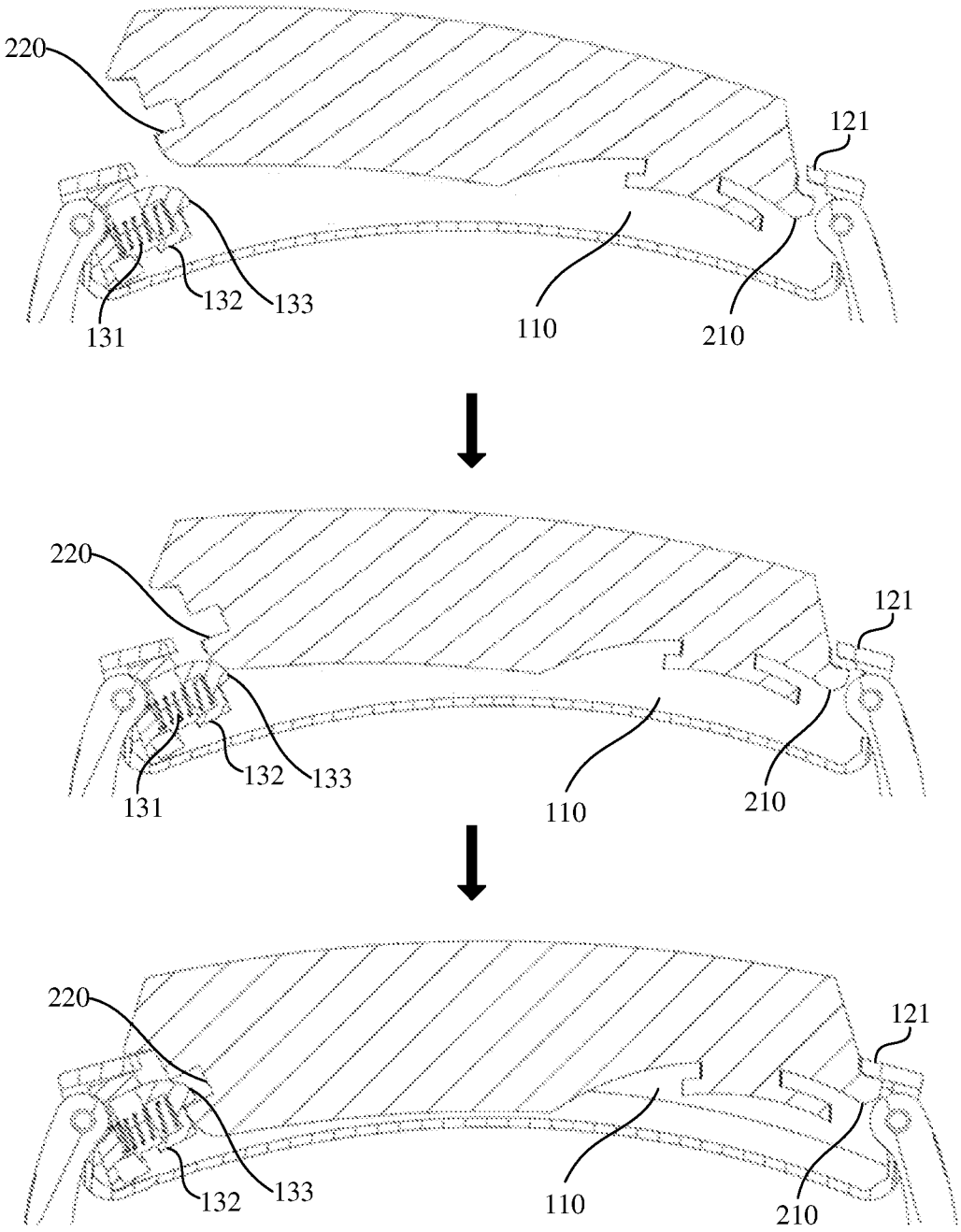
FIG. 8 is a still another diagram of a headset accommodating apparatus according to an embodiment of this application.

As shown in FIG. 8, first, the protruding end 210 of the headset head is placed into the accommodating cavity 110. Then, the headset is pressed downward, making the headset push the sliding block 132 to compress the first spring 131, so that the recess part 220 of the headset tail is clamped to the protruding part 133 of the sliding block 132 in the apparatus.

Figure 9A:
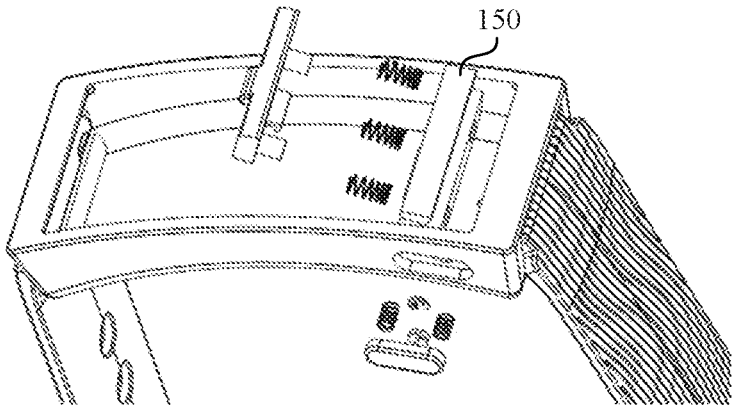
FIG. 9*a* is a schematic structural diagram of a headset accommodating apparatus according to an embodiment of this application.
Figure 9B:
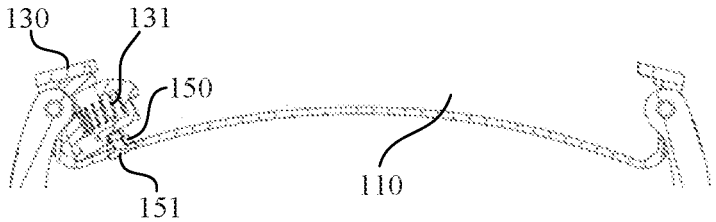
FIG. 9*b* is a schematic structural view of another headset accommodating apparatus according to an embodiment of this application.

It should be noted that the headset accommodating apparatus in this application may further include a fastening block 150 as shown in FIG. 9*a*. In an example embodiment, as shown in FIG. 9*b*, one end of the fastening block 150 is fastened on the second end 130 of the accommodating cavity 110 by using a screw 151, and the other end of the fastening block 150 is connected to the first spring 131. By disposing the fastening block 150, when a joint between the second spring 142 and the fastening block 150, or the like in the headset accommodating apparatus is damaged, the entire base 100 does not need to be replaced, but only the fastening block 150 needs to be replaced, thereby reducing economic loss of a user and improving customer experience.

According to the headset accommodating apparatus and the headset provided in the embodiments of this application, the epitaxial frame 121 is disposed on one end of the accommodating cavity 110 formed on the base, and the first spring 131 and the sliding block 132 are disposed on the other end. The protruding end 210 is provided at the headset head, and the recess part 220 is provided at the headset tail. The headset is pressed downward, and the sliding block 132 is pushed to compress the first spring 131, so that the protruding part 133 on the sliding block 132 is clamped to the recess part 220 of the headset tail, and the protruding end 210 of the headset head is limited within the accommodating cavity 110 by the epitaxial frame 121, so that the headset can be conveniently, quickly, and stably accommodated in the headset accommodating apparatus. When the headset needs to be taken out, the headset is pressed toward the second end 130 of the accommodating cavity 110, the sliding block 132 is pushed to compress the first spring 131, and the protruding end 210 of the headset head moves toward the second end 130 of the accommodating cavity 110 to detach from the epitaxial frame 121, so that the headset can be conveniently and quickly taken out from the headset accommodating apparatus.

Further, by disposing the insurance mechanism, when the insurance button 143 is not pressed, the headset cannot be released from the accommodating apparatus, thereby preventing the headset from falling off due to an external force and is lost without being realized by a user. Still further, by using an implementation in which the second concave plane 520 of the headset tail moves at most to contact with the axial end surface 1434, a compression length obtained when the headset pushes the sliding block 132 to compress the first spring 131 may be limited, to effectively avoid a situation in which the headset flies out and be broken because of an excessively strong restoring force generated by the first spring 131 when a user takes out the headset from the headset accommodating apparatus. In addition, by disposing the fastening block 150, when a joint between the second spring 142 and the fastening block 150, or the like in the headset accommodating apparatus is damaged, the entire base 100 does not need to be replaced, but only the fastening block 150 needs to be replaced, thereby reducing economic loss of a user and improving customer experience.

It should be noted that an embodiment of this application further provides a portable device. The device may include any one of the headset accommodating apparatuses in the foregoing embodiments. In addition, the device may further include any one of the headsets according to the foregoing embodiments.

In the foregoing specific implementations, the objective, technical solutions, and benefits of this application are further described in detail. It should be understood that the foregoing descriptions are merely specific implementations of this application, but are not intended to limit the protection scope of this application. Any modification, equivalent replacement, or improvement made without departing from the spirit and principle of this application should fall within the protection scope of this application.

What is claimed is:

1. A headset accommodating apparatus, comprising:

a base;

an accommodating cavity formed on the base and configured to accommodate a headset, the accommodating cavity having a bottom surface, a side wall, and an opening, the accommodating cavity further having a first end corresponding to a headset head and a second end corresponding to a headset tail;

an epitaxial frame formed at an opening of the first end of the accommodating cavity and extending toward the second end of the accommodating cavity;

a first spring;

a sliding block positioned at a side wall of the second end of the accommodating cavity, wherein the first spring is configured for compression in a direction of a connecting line between the first end of the accommodating cavity and the second end of the accommodating cavity, a first end of the sliding block is connected to the first spring, and a protruding part is formed on a second end of the sliding block; and an insurance mechanism having a clamp spring, a second spring, and an insurance button, wherein the insurance button is removably fastened on the side wall of the accommodating cavity by using the clamp spring and the second spring, wherein when the headset accommodating apparatus is in a first state, a protruding end of the headset head is limited within the accommodating cavity by the epitaxial frame, and the protruding part on the sliding block is clamped to a recess part of the headset tail, when the headset accommodating apparatus is in a second state, the sliding block compresses the first spring under a push of the headset, and the protruding end of the headset head moves toward the second end of the accommodating cavity to detach from the epitaxial frame, so that the headset can be released from the opening of the accommodating cavity, the insurance button having a first end facing an inner side of the accommodating cavity, a second end facing an outer side of the accommodating cavity, and a coupling shaft connecting the first end of the insurance button and the second end of the insurance button, wherein a fitting hole is provided on the side wall of the accommodating cavity, and the first end of the insurance button is inserted into the accommodating cavity through the fitting hole, and an axial end surface parallel to an axial direction of the coupling shaft is formed at the first end of the insurance button, on the headset tail, a concave cavity is further formed on a side proximate to the insurance mechanism, a first concave plane and a second concave plane are formed in a step-shape in the concave cavity, the first concave plane is closer to an outer side of the headset compared with the second concave plane, and a distance from the second concave plane to the headset head is shorter than a distance from the first concave plane to the headset head, when the headset accommodating apparatus is in the first state, the axial end surface is in contact with a first concave plane on the headset tail, and when the headset accommodating apparatus is in the second state, the insurance button compresses the second spring, the axial end surface is detached from the first concave plane, and the insurance button moves in an axial direction to a position that is opposite to the second concave plane in the concave cavity.

2. The headset accommodating apparatus according to claim 1, wherein the fitting hole includes a through-hole and a recessed surface, wherein a cross section of the through-hole is smaller than the recessed surface, a groove is provided on the coupling shaft at a position proximate to the first end of the insurance button, and the clamp spring is inserted into the groove and fastened on the side wall of the accommodating cavity;

a first end of the second spring is in contact with the second end of the insurance button, and a second end of the second spring is in contact with the recessed surface; and a thickness of the clamp spring is less than a width of the groove, and the second spring is configured for compression in an axial direction of the coupling shaft under the push of the insurance button.

3. The headset accommodating apparatus according to claim 1, further comprising:

a fastening block, wherein a first end of the fastening block is fastened on the second end of the accommodating cavity by using a screw, and a second end of the fastening block is connected to the first spring.

4. The headset accommodating apparatus according to claim 1, wherein the epitaxial frame is an extension frame.

5. The headset accommodating apparatus according to claim 1, wherein the epitaxial frame extends toward the sliding block positioned at the side wall of the second end of the accommodating cavity.

6. A headset configured to be detachably accommodated in a headset accommodating apparatus, the headset comprising:

a protruding end formed at a headset head; and a recess part formed at a headset tail, wherein the headset accommodating apparatus includes:

a base;

an accommodating cavity formed on the base and configured to accommodate the headset, the accommodating cavity having a bottom surface, a side wall, and an opening, the accommodating cavity further having a first end and a second end;

an epitaxial frame formed at an opening of the first end of the accommodating cavity and extending toward the second end of the accommodating cavity;

a first spring;

a sliding block positioned at a side wall of the second end of the accommodating cavity, wherein the first spring is configured for compression in a direction of a connecting line between the first end of the accommodating cavity and the second end of the accommodating cavity, a first end of the sliding block is connected to the first spring, and a protruding part is formed on a second end of the sliding block; and a fastening block, wherein a first end of the fastening block is fastened on the second end of the accommodating cavity by using a screw, and a second end of the fastening block is connected to the first spring, wherein when the headset accommodating apparatus is in the first state, the protruding end of the headset head is limited within the accommodating cavity in the headset accommodating apparatus by the epitaxial frame of the headset accommodating apparatus, and the recess part of the headset tail is clamped to the protruding part of the sliding block in the headset accommodating apparatus, and when the headset accommodating apparatus is in the second state, the headset pushes the sliding block to compress the first spring, the protruding end of the headset head moves toward the second end of the accommodating cavity to detach from the epitaxial frame, so that the headset can be released from the opening.

7. The headset according to claim 6, wherein the headset accommodating apparatus further comprises an insurance mechanism having a clamp spring;

on the headset tail, a concave cavity is further formed on a side proximate to the insurance mechanism, a first concave plane and a second concave plane are formed in a step-shape in the concave cavity; the first concave plane is closer to an outer side of the headset compared with the second concave plane, and a distance from the second concave plane to the headset head is shorter than a distance from the first concave plane to the headset head;

the headset accommodating apparatus further comprises a second spring and an insurance button; the insurance button is configured to be removably fastened on the side wall of the accommodating cavity by using the clamp spring and the second spring; the insurance button comprises a first end facing an inner side of the accommodating cavity, a second end facing an outer side of the accommodating cavity, and a coupling shaft connecting the first end of the insurance button and the second end of the insurance button; a fitting hole is provided on the side wall of the accommodating cavity, and the first end of the insurance button is inserted into the accommodating cavity through the fitting hole; and an axial end surface parallel to an axial direction of the coupling shaft is formed at the first end of the insurance button; and when the headset accommodating apparatus is in the first state, a first concave plane on the headset tail is in contact with the axial end surface of the insurance mechanism.

8. The headset according to claim 7, wherein when the headset accommodating apparatus is in the second state, a second concave plane on the headset tail moves to contact with the axial end surface of the insurance mechanism.

9. A headset accommodating apparatus, comprising:

a base;

an accommodating cavity formed on the base and configured to accommodate a headset, the accommodating cavity having a bottom surface, a side wall, and an opening, the accommodating cavity further having a first end corresponding to a headset head and a second end corresponding to a headset tail;

an epitaxial frame formed at an opening of the first end of the accommodating cavity and extending toward the second end of the accommodating cavity;

a first spring;

a sliding block positioned at a side wall of the second end of the accommodating cavity, wherein the first spring is configured for compression in a direction of a connecting line between the first end of the accommodating cavity and the second end of the accommodating cavity, a first end of the sliding block is connected to the first spring, and a protruding part is formed on a second end of the sliding block; and a fastening block, wherein a first end of the fastening block is fastened on the second end of the accommodating cavity by using a screw, and a second end of the fastening block is connected to the first spring, wherein when the headset accommodating apparatus is in a first state, a protruding end of the headset head is limited within the accommodating cavity by the epitaxial frame, and the protruding part on the sliding block is clamped to a recess part of the headset tail, and when the headset accommodating apparatus is in a second state, the sliding block compresses the first spring under a push of the headset, and the protruding end of the headset head moves toward the second end of the accommodating cavity to detach from the epitaxial frame, so that the headset can be released from the opening of the accommodating cavity.

10. The headset accommodating apparatus according to claim 9, further comprising an insurance mechanism having a clamp spring, a second spring, and an insurance button, wherein the insurance button is removably fastened on the side wall of the accommodating cavity by using the clamp spring and the second spring, the insurance button having a first end facing an inner side of the accommodating cavity, a second end facing an outer side of the accommodating cavity, and a coupling shaft connecting the first end of the insurance button and the second end of the insurance button, wherein a fitting hole is provided on the side wall of the accommodating cavity, and the first end of the insurance button is inserted into the accommodating cavity through the fitting hole, and an axial end surface parallel to an axial direction of the coupling shaft is formed at the first end of the insurance button.

11. The headset accommodating apparatus according to claim 10, wherein on the headset tail, a concave cavity is further formed on a side proximate to the insurance mechanism, a first concave plane and a second concave plane are formed in a step-shape in the concave cavity, the first concave plane is closer to an outer side of the headset compared with the second concave plane, and a distance from the second concave plane to the headset head is shorter than a distance from the first concave plane to the headset head.

12. The headset accommodating apparatus according to claim 11, wherein when the headset accommodating apparatus is in the first state, the axial end surface is in contact with a first concave plane on the headset tail; and when the headset accommodating apparatus is in the second state, the insurance button compresses the second spring, the axial end surface is detached from the first concave plane, and the insurance button moves in an axial direction to a position that is opposite to the second concave plane in the concave cavity.

* * * * *